US012377311B2

(12) United States Patent
Tsai

(10) Patent No.: US 12,377,311 B2
(45) Date of Patent: Aug. 5, 2025

(54) TREADMILL HAVING SOFT WALKING BOARD ASSEMBLY WITH FUNCTIONS OF HEAT DISSIPATION, SHOCK ABSORPTION, AND WEAR RESISTANCE

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 131 days.

(21) Appl. No.: 18/397,045

(22) Filed: Dec. 27, 2023

(65) Prior Publication Data

US 2025/0213915 A1 Jul. 3, 2025

(51) Int. Cl.
*A63B 22/02* (2006.01)

(52) U.S. Cl.
CPC ..... *A63B 22/0285* (2013.01); *A63B 22/0207* (2015.10); *A63B 2209/00* (2013.01)

(58) Field of Classification Search
CPC ..... A63B 22/02–0292; A63B 2209/00; B65G 15/60; B65G 15/62
See application file for complete search history.

(56) References Cited

U.S. PATENT DOCUMENTS 4,616,822 A * 10/1986 Trulaske ..... A63B 22/02 198/841
12,011,637 B2 * 6/2024 Corbalis ..... A63B 22/0214
2007/0298937 A1 * 12/2007 Shah ..... A63B 22/02 482/54

FOREIGN PATENT DOCUMENTS

KR 20060010556 A * 2/2006 ..... A63B 22/0285

* cited by examiner

*Primary Examiner* — Loan B Jimenez
*Assistant Examiner* — Kathleen M Fisk
(74) *Attorney, Agent, or Firm* — Chun-Ming Shih; LANWAY IPR SERVICES

(57) ABSTRACT

A treadmill includes two side frames, a walking board assembly mounted between the two side frames, and a walking belt encircling the walking board assembly. The walking board assembly includes a support plate, a shock-absorbing layer, a wear-resistant layer, and two thermal conducting strips. The shock-absorbing layer has a bottom face abutting a top face of the support plate. The wear-resistant layer has a bottom face abutting a top face of the shock-absorbing layer and the top face of the support plate. The thermal conducting strips abut the shock-absorbing layer and are arranged at a middle position of the support plate. Each of the thermal conducting strips has a front end and a rear end abutting the top face of the support plate. Thus, the wear-resistant layer completely covers the thermal conducting strips and the shock-absorbing layer on the support plate.

8 Claims, 6 Drawing Sheets

TREADMILL HAVING SOFT WALKING BOARD ASSEMBLY WITH FUNCTIONS OF HEAT DISSIPATION, SHOCK ABSORPTION, AND WEAR RESISTANCE

BACKGROUND OF THE INVENTION

Field of the Invention

The present invention relates to an exercising machine and, more particularly, to a treadmill having a soft walking board assembly.

Description of the Related Art

A conventional treadmill comprises a walking board, and a walking belt mounted around the walking board. The walking belt rotates on the walking board along a closed trajectory, to facilitate the user stepping or running on the walking board successively. However, when the user is running on the treadmill, the weight of the user's body exerts a force on the walking belt and the walking board, so that a high temperature is generated between the walking belt and the walking board due to high-speed friction during a long-term utilization. Thus, the walking belt is easily damaged by the high temperature. In addition, the walking belt and the walking board are worn out rapidly due to the frequent friction, thereby shortening the lifetime thereof.

Another conventional treadmill comprises a surface layer stuck or bonded on the walking board. The surface layer is wearproof and resistant to a high temperature. In addition, lubricating oil or wax is sprayed on the surface layer to reduce the friction between the walking belt and the walking board so that the walking belt is moving on the walking board smoothly, thereby preventing from incurring resistance and high temperature due to frequent friction during a long-term utilization. However, the user needs to replenish the lubricating oil or wax after use during a period of time, thereby greatly causing inconvenience to the user, and thereby increasing the cost. In addition, the walking belt is easily damaged if the user forgets to refill the lubricating oil or wax.

BRIEF SUMMARY OF THE INVENTION

The primary objective of the present invention is to provide a treadmill having a soft walking board assembly with functions of heat dissipation, shock absorption, and wear resistance.

In accordance with the present invention, there is provided a treadmill comprising two side frames, a walking board assembly mounted between the two side frames, and a walking belt encircling the walking board assembly. The walking board assembly includes a support plate, a shock-absorbing layer, a wear-resistant layer, and two thermal conducting strips. The support plate is made of a composite board. The shock-absorbing layer has a soft feature. The shock-absorbing layer has a bottom face abutting a top face of the support plate. The shock-absorbing layer has a thickness of 0.2 cm to 0.3 cm. The shock-absorbing layer has a length less than a length of the support plate. The shock-absorbing layer has a width less than a width of the support plate. The wear-resistant layer has a flexible feature. The wear-resistant layer has a thickness of 0.1 mm to 0.2 mm. The wear-resistant layer has a length more than the length of the shock-absorbing layer. The wear-resistant layer has a width more than the width of the shock-absorbing layer. The width of the wear-resistant layer is less than the width of the support plate. The wear-resistant layer has a bottom face abutting a top face of the shock-absorbing layer and the top face of the support plate. The support plate has two sides located outside of two sides of the wear-resistant layer respectively, with a width defined between each of the two sides of the support plate and each of the two sides of the wear-resistant layer. The width allows fixing of the two side frames on the support plate. Each of the two thermal conducting strips is made of metal foil and has a flexible feature. Each of the two thermal conducting strips has a thickness of 0.2 mm to 0.5 mm. Each of the two thermal conducting strips has a longitudinal length less than the length of the wear-resistant layer and more than the length of the shock-absorbing layer. The two thermal conducting strips are parallel with each other. The two thermal conducting strips longitudinally abut the shock-absorbing layer and are arranged at a middle position of the support plate. Each of the two thermal conducting strips has a front end and a rear end abutting the top face of the support plate. Thus, the wear-resistant layer completely covers the two thermal conducting strips and the shock-absorbing layer on the support plate.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
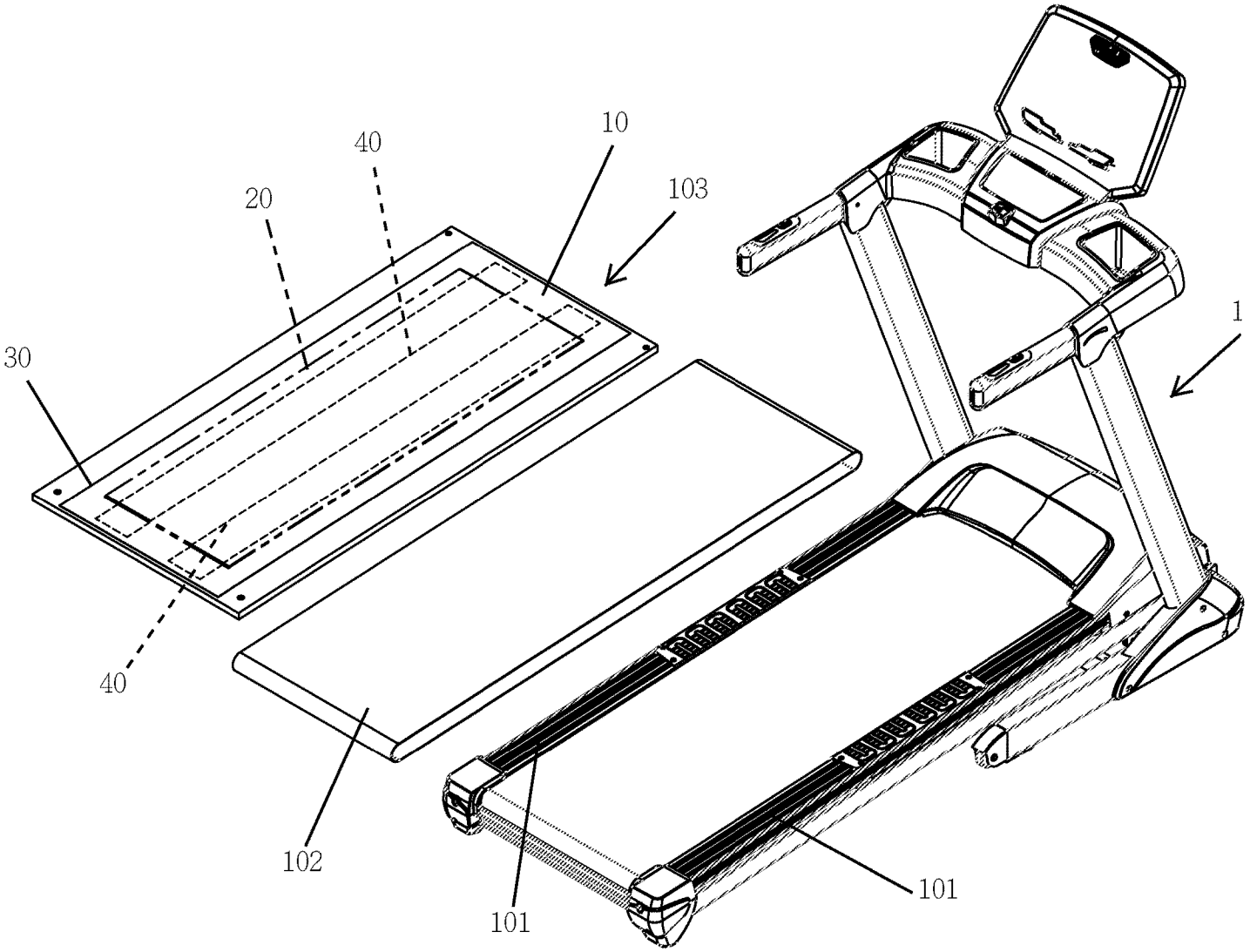
FIG. 1 is an exploded perspective view of a treadmill in accordance with the first preferred embodiment of the present invention.
Figure 2:
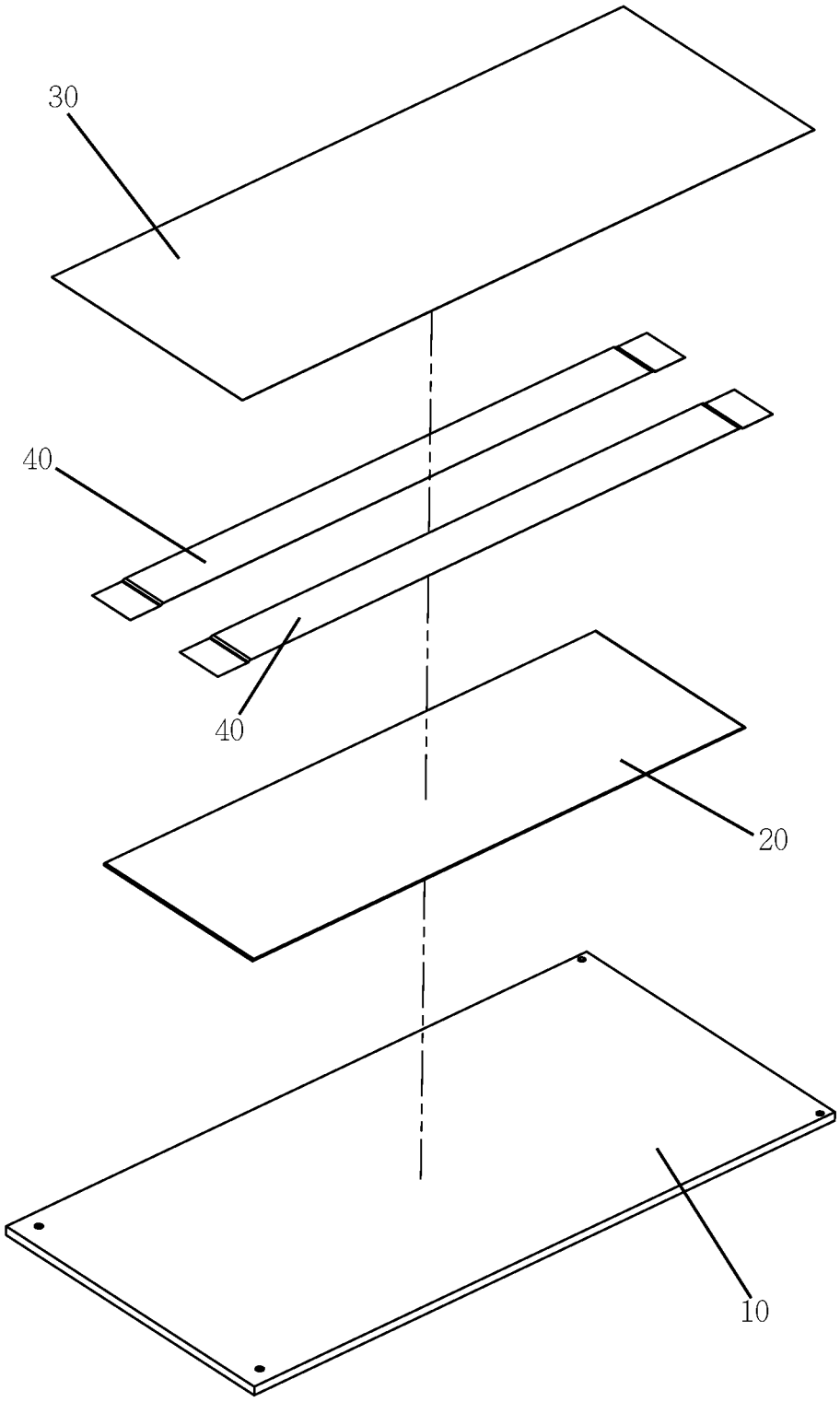
FIG. 2 is an exploded perspective view of a walking board assembly of the treadmill in accordance with the first preferred embodiment of the present invention.
Figure 3:
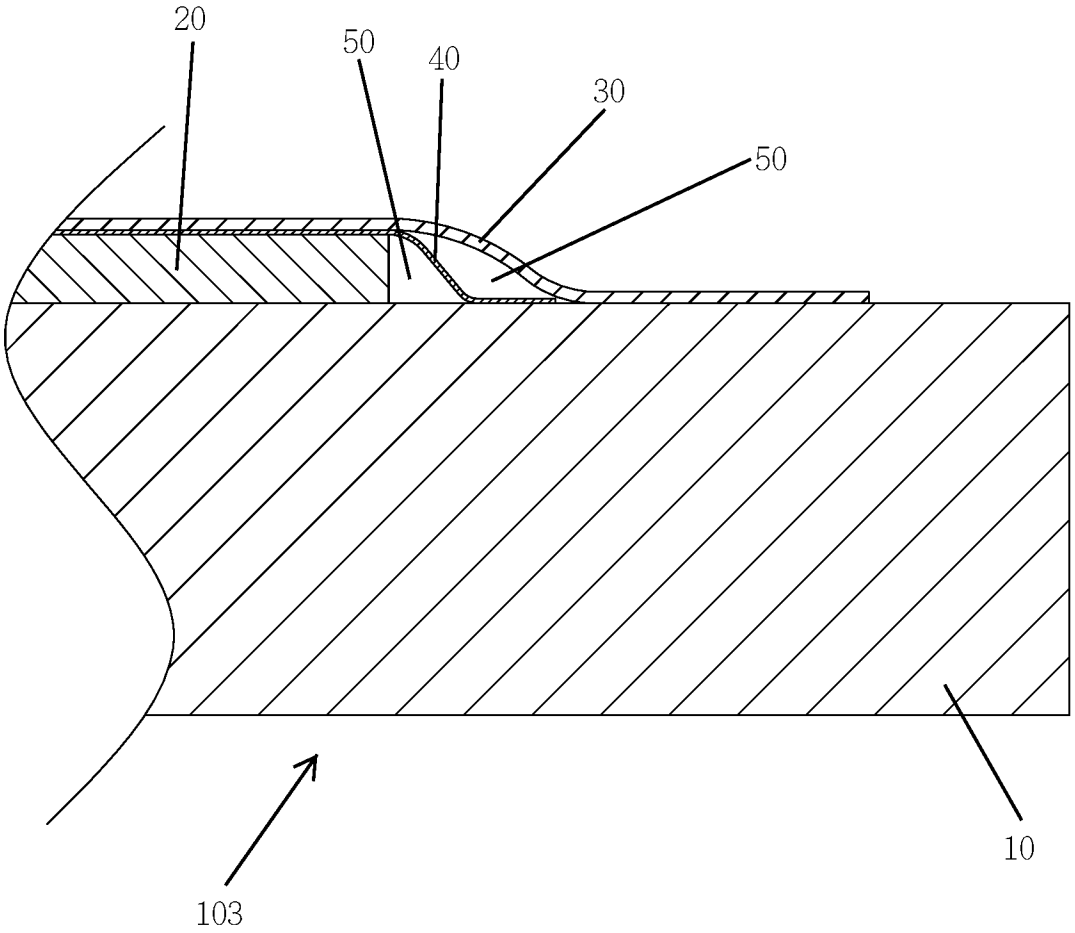
FIG. 3 is a locally enlarged cross-sectional assembly view of the walking board assembly as shown in FIG. 2.
Figure 4:
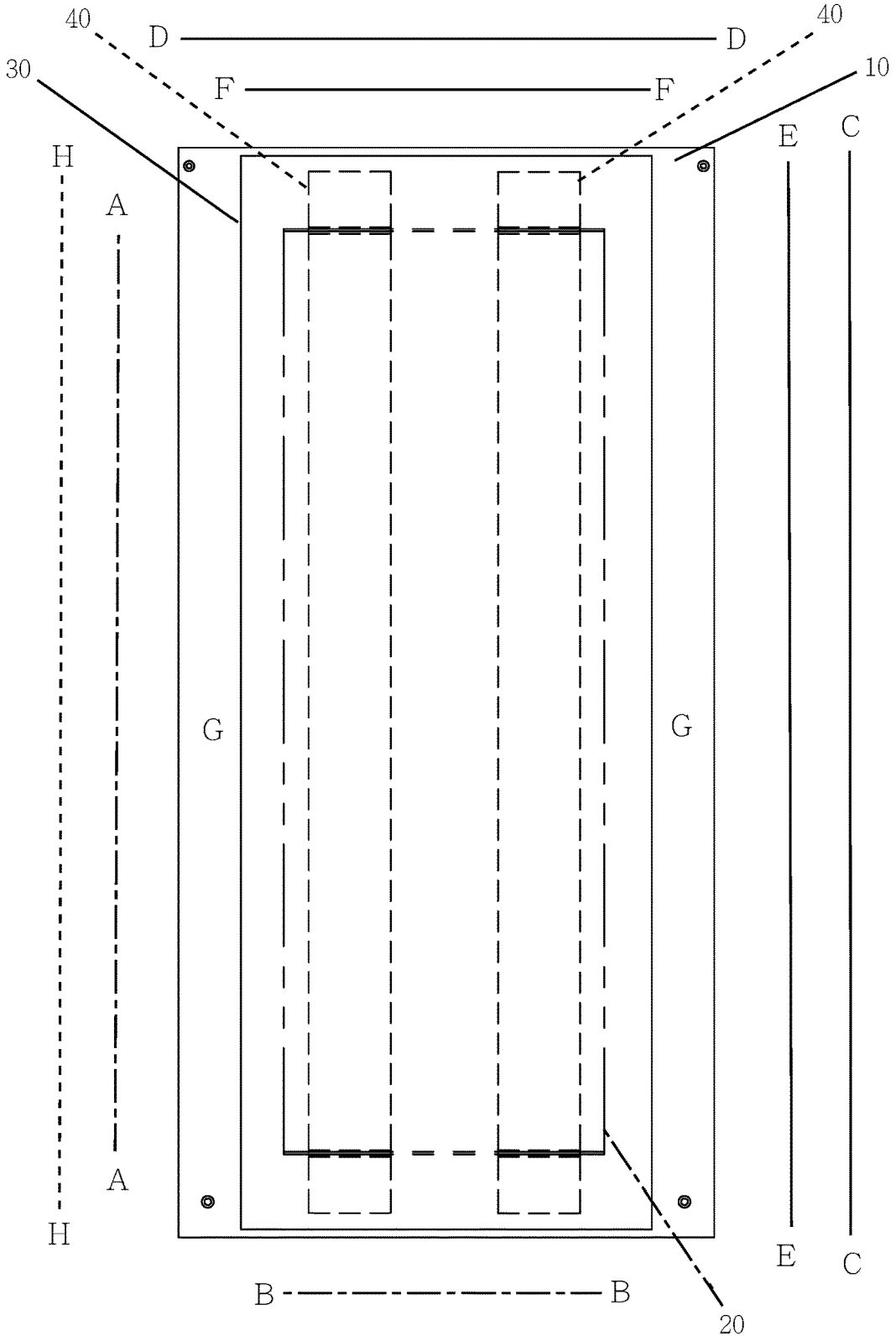
FIG. 4 is a top assembly view of the walking board assembly as shown in FIG. 2.

Referring to the drawings and initially to FIGS. 1-4, a treadmill 1 in accordance with the preferred embodiment of the present invention comprises two side frames 101, a walking (or running) board assembly 103 mounted between the two side frames 101, and a walking (or running) belt 102 encircling the walking board assembly 103.

The walking board assembly 103 includes a support plate 10, a shock-absorbing (or vibration damping) layer 20, a wear-resistant (or wear-proof) layer 30, and two thermal conducting strips 40.

The support plate 10 is made of a composite board.

The shock-absorbing layer 20 has a soft feature. The shock-absorbing layer 20 has a bottom face abutting (or bonded on) a top face of the support plate 10. The shock-absorbing layer 20 has a thickness of 0.2 cm to 0.3 cm. The shock-absorbing layer 20 has a length AA less than a length CC of the support plate 10. The shock-absorbing layer 20 has a width BB less than a width DD of the support plate 10.

The wear-resistant layer 30 has a flexible feature. The wear-resistant layer 30 has a thickness of 0.1 mm to 0.2 mm. The wear-resistant layer 30 has a length EE more than the length AA of the shock-absorbing layer 20. The wear-resistant layer 30 has a width FF more than the width BB of the shock-absorbing layer 20. The width FF of the wear-resistant layer 30 is less than the width DD of the support plate 10. The wear-resistant layer 30 has a bottom face abutting (or bonded on) a top face of the shock-absorbing layer 20 and the top face of the support plate 10. The support plate 10 has two sides located outside of two sides of the wear-resistant layer 30 respectively, with a width G defined between each of the two sides of the support plate 10 and each of the two sides of the wear-resistant layer 30. Thus, the width G of the support plate 10 is equal to half of the width DD of the support plate 10 minus the width FF of the wear-resistant layer 30, or G=½(DD−FF). The width G allows fixing of the two side frames 101 on the support plate 10.

Each of the two thermal conducting strips 40 is made of metal foil and has a flexible feature. Each of the two thermal conducting strips 40 has a thickness of 0.2 mm to 0.5 mm. Each of the two thermal conducting strips 40 has a longitudinal length HH less than the length EE of the wear-resistant layer 30 and more than the length AA of the shock-absorbing layer 20. The two thermal conducting strips 40 are parallel with each other. The two thermal conducting strips 40 longitudinally abut the shock-absorbing layer 20 and are arranged at a middle position of the support plate 10. Each of the two thermal conducting strips 40 has a front end and a rear end abutting (or bonded on) the top face of the support plate 10. Thus, the wear-resistant layer 30 completely covers the two thermal conducting strips 40 and the shock-absorbing layer 20 on the support plate 10.

In the preferred embodiment of the present invention, the shock-absorbing layer 20 is made of ethylene-vinyl acetate (EVA) copolymer, polyurethane (PU) or foam.

In the preferred embodiment of the present invention, the wear-resistant layer 30 is made of polyoxymethylene (POM), polyethylene terephthalate (PET) or Nylon.

In the preferred embodiment of the present invention, each of the two thermal conducting strips 40 is made of copper foil.

In the preferred embodiment of the present invention, each of the two thermal conducting strips 40 is made of aluminum foil.

In the preferred embodiment of the present invention, the two thermal conducting strips 40 are located between the wear-resistant layer 30 and the shock-absorbing layer 20, and each of the two thermal conducting strips 40 has a top face longitudinally abutting (or bonded on) the bottom face of the wear-resistant layer 30 and a bottom face longitudinally abutting (or bonded on) the top face of the shock-absorbing layer 20.

In the preferred embodiment of the present invention, the two thermal conducting strips 40 are spaced from each other with a distance equal to that between the user's two feet.

In practice, the two thermal conducting strips 40 are located between the wear-resistant layer 30 and the shock-absorbing layer 20. When the user is running on the walking board assembly 103, the walking belt 102 is rotated and successively rubs the wear-resistant layer 30 during a long period of time. In addition, when the user treads and presses the walking belt 102, the stress is largely applied on a determined region of the walking board assembly 103, so that a high temperature is produced between the wear-resistant layer 30 and the walking belt 102 at the determined region of the walking board assembly 103. At this time, the two thermal conducting strips 40 have a great thermal conducting feature, so that the high temperature between the wear-resistant layer 30 and the walking belt 102 is distributed to the two thermal conducting strips 40, and is dissipated outward from the front end and the rear end of each of the two thermal conducting strips 40. It is noted that, the front end and the rear end of each of the two thermal conducting strips 40 are spaced from the wear-resistant layer 30, with a circulation space 50 being defined between the front end and the rear end of each of the two thermal conducting strips 40, and the wear-resistant layer 30, thereby forming a relatively lower temperature difference. Further, the high temperature between the wear-resistant layer 30 and the walking belt 102 is delivered and dissipated outward from the front end and the rear end of each of the two thermal conducting strips 40 to the shock-absorbing layer 20.

Thus, the high temperature produced by a friction between the wear-resistant layer 30 and the walking belt 102 is dispersed and distributed to the two thermal conducting strips 40 and the shock-absorbing layer 20, thereby reducing the temperature between the wear-resistant layer 30 and the walking belt 102 and achieving a heat radiating effect.

Figure 5:
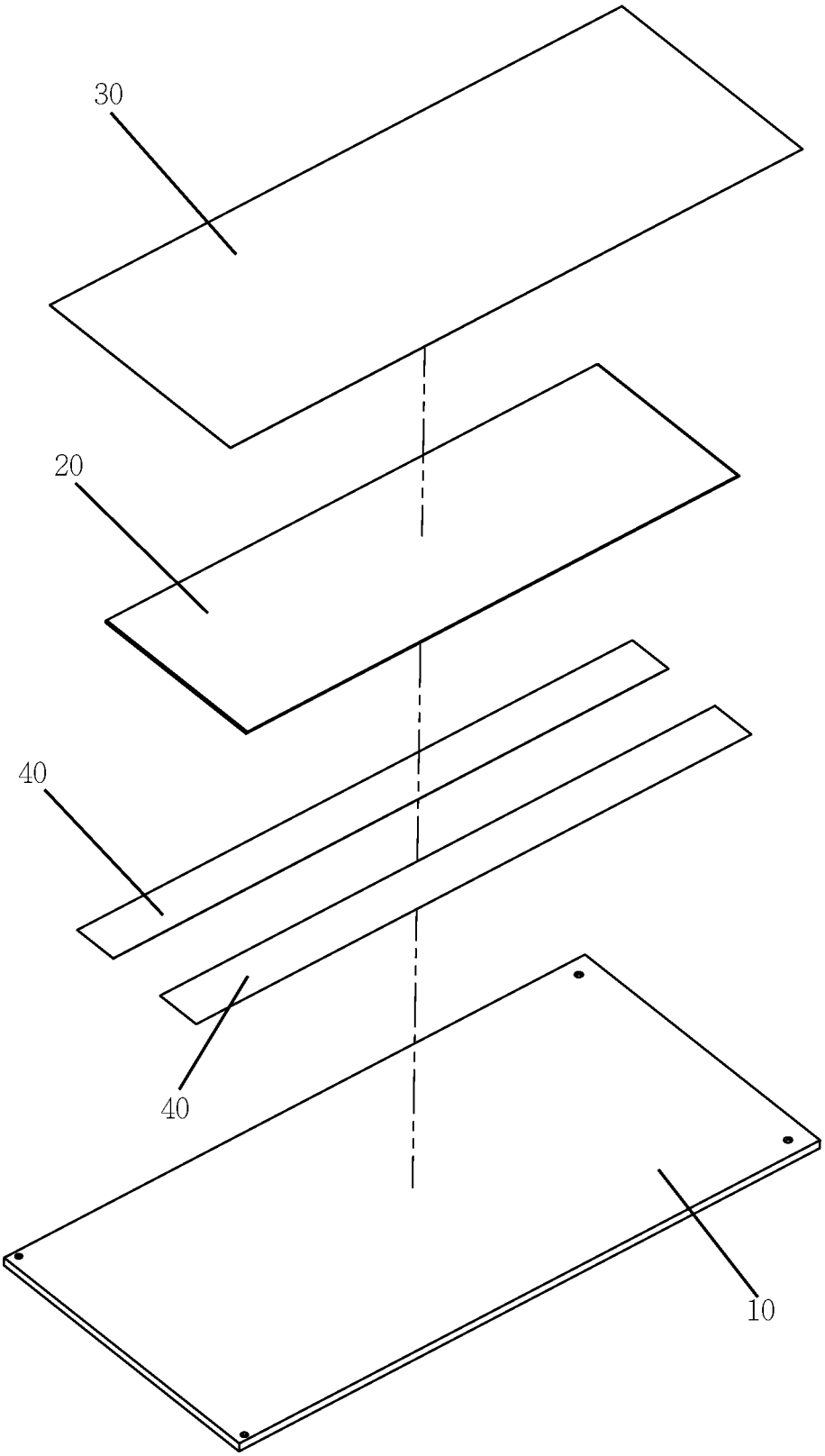
FIG. 5 is an exploded perspective view of a walking board assembly of the treadmill in accordance with the second preferred embodiment of the present invention.
Figure 6:
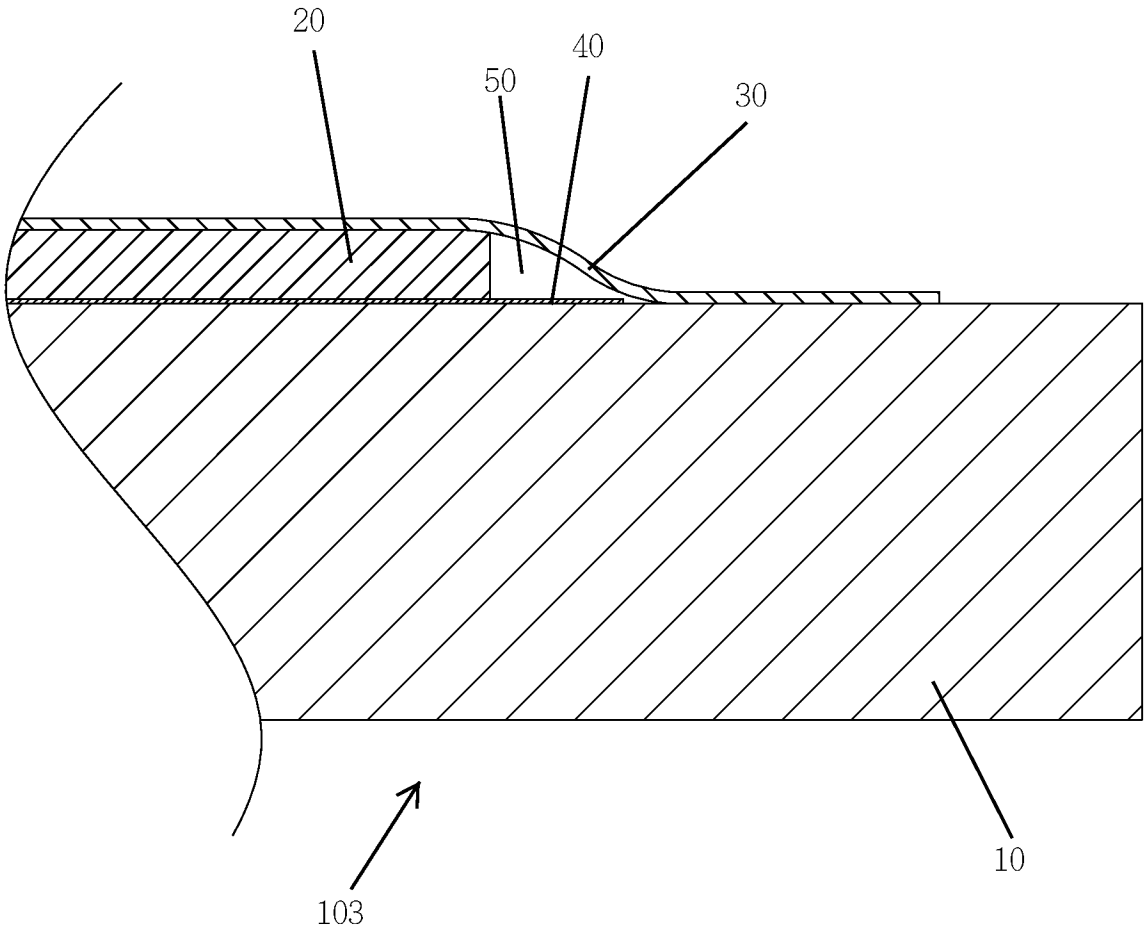
FIG. 6 is a locally enlarged cross-sectional assembly view of the walking board assembly as shown in FIG. 5.

Referring to FIGS. 5 and 6, the two thermal conducting strips 40 are located between the shock-absorbing layer 20 and the support plate 10, and each of the two thermal conducting strips 40 has a top face longitudinally abutting (or bonded on) the bottom face of the shock-absorbing layer 20 and a bottom face longitudinally abutting (or bonded on) the top face of the support plate 10.

In practice, the two thermal conducting strips 40 are located between the shock-absorbing layer 20 and the support plate 10. At this time, the two thermal conducting strips 40 have a great thermal conducting feature, so that the high temperature between the wear-resistant layer 30 and the walking belt 102 is conducted through the shock-absorbing layer 20 to the two thermal conducting strips 40, and is dissipated outward from the front end and the rear end of each of the two thermal conducting strips 40. It is noted that, the front end and the rear end of each of the two thermal conducting strips 40 are spaced from the wear-resistant layer 30, with a circulation space 50 being defined between the front end and the rear end of each of the two thermal conducting strips 40, and the wear-resistant layer 30, thereby forming a relatively lower temperature difference. Further, the high temperature between the wear-resistant layer 30 and the walking belt 102 is delivered and dissipated outward from the front end and the rear end of each of the two thermal conducting strips 40 to the support plate 10.

Thus, the high temperature produced by a friction between the wear-resistant layer 30 and the walking belt 102 is dispersed and distributed to the shock-absorbing layer 20, the two thermal conducting strips 40, and the support plate 10, thereby reducing the temperature between the wear-resistant layer 30 and the walking belt 102 and achieving a heat radiating effect.

Accordingly, the walking board assembly 103 has the following advantages.

1. The high temperature between the wear-resistant layer 30 and the walking belt 102 is conducted through the two thermal conducting strips 40 and dissipated outward from the front end and the rear end of each of the two thermal conducting strips 40, so that the walking board assembly 103 has an excellent heat conducting and dissipating effect.

2. When the user is operating the treadmill 1, the user's two feet usually treads on the middle position of the walking board assembly 103. At this time, the two thermal conducting strips 40 are arranged at the middle position of the support plate 10 and spaced from each other with a distance equal to that between the user's two feet. Thus, the two thermal conducting strips 40 provide the optimum heat dissipation effect.

3. When the user treads on the walking board assembly 103, the shock-absorbing layer 20 provides a buffering function to achieve a vibration damping effect.

4. The wear-resistant layer 30 provides a wear-proof effect to the walking board assembly 103 so that the walking board assembly 103 is not torn or worn out easily when the wear-resistant layer 30 rubs the walking belt 102 successively.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A treadmill comprising:

two side frames, a walking board assembly mounted between the two side frames, and a walking belt encircling the walking board assembly;

wherein:

the walking board assembly includes a support plate, a shock-absorbing layer, a wear-resistant layer, and two thermal conducting strips;

the support plate is made of a composite board;

the shock-absorbing layer has a soft feature;

the shock-absorbing layer has a bottom face abutting a top face of the support plate;

the shock-absorbing layer has a thickness of 0.2 cm to 0.3 cm;

the shock-absorbing layer has a length less than a length of the support plate;

the shock-absorbing layer has a width less than a width of the support plate;

the wear-resistant layer has a flexible feature;

the wear-resistant layer has a thickness of 0.1 mm to 0.2 mm;

the wear-resistant layer has a length more than the length of the shock-absorbing layer;

the wear-resistant layer has a width more than the width of the shock-absorbing layer;

the width of the wear-resistant layer is less than the width of the support plate;

the wear-resistant layer has a bottom face abutting a top face of the shock-absorbing layer and the top face of the support plate;

the support plate has two sides located outside of two sides of the wear-resistant layer respectively, with a width defined between each of the two sides of the support plate and each of the two sides of the wear-resistant layer;

the width defined between each of the two sides of the support plate and each of the two sides of the wear-resistant layer allows fixing of the two side frames on the support plate;

each of the two thermal conducting strips is made of metal foil and has a flexible feature;

each of the two thermal conducting strips has a thickness of 0.2 mm to 0.5 mm;

each of the two thermal conducting strips has a longitudinal length less than the length of the wear-resistant layer and more than the length of the shock-absorbing layer;

the two thermal conducting strips are parallel with each other;

the two thermal conducting strips longitudinally abut the shock-absorbing layer and are arranged at a middle position of the support plate;

each of the two thermal conducting strips has a front end and a rear end abutting the top face of the support plate; and the wear-resistant layer completely covers the two thermal conducting strips and the shock-absorbing layer on the support plate.

2. The treadmill as claimed in claim 1, wherein the shock-absorbing layer is made of ethylene-vinyl acetate (EVA) copolymer, polyurethane (PU) or foam.

3. The treadmill as claimed in claim 1, wherein the wear-resistant layer is made of polyoxymethylene (POM), polyethylene terephthalate (PET) or Nylon.

4. The treadmill as claimed in claim 1, wherein each of the two thermal conducting strips is made of copper foil.

5. The treadmill as claimed in claim 1, wherein each of the two thermal conducting strips is made of aluminum foil.

6. The treadmill as claimed in claim 1, wherein each of the two thermal conducting strips has a top face longitudinally abutting the bottom face of the wear-resistant layer and a bottom face longitudinally abutting the top face of the shock-absorbing layer.

7. The treadmill as claimed in claim 1, wherein each of the two thermal conducting strips has a top face longitudinally abutting the bottom face of the shock-absorbing layer and a bottom face longitudinally abutting the top face of the support plate.

8. The treadmill as claimed in claim 1, wherein the two thermal conducting strips are spaced from each other.

* * * * *